US005563490A

United States Patent [19]

Kawaguchi et al.

[11] Patent Number: 5,563,490

[45] Date of Patent: Oct. 8, 1996

[54] PUMP SYSTEM WITH LIQUID COOLING OPERATION

[75] Inventors: Kyoji Kawaguchi, Tokyo; Masakazu Yamamoto, Fujisawa; Yoshio Miyake, Fujisawa; Koji Isemoto, Fujisawa; Keita Uwai, Fujisawa, all of Japan

[73] Assignee: Ebara Corporation, Tokyo, Japan

[21] Appl. No.: 309,897

[22] Filed: Sep. 20, 1994

[30] Foreign Application Priority Data

Sep. 20, 1993 [JP] Japan ..... 5-256521

[51] Int. Cl.[6] ..... H02P 11/00

[52] U.S. Cl. ..... 318/808; 417/44.1

[58] Field of Search ..... 318/798–810; 363/40, 41, 55–58; 417/1, 18, 31, 32, 44

[56] References Cited

U.S. PATENT DOCUMENTS

| | | | |
|---|---|---|---|
| 3,751,192 | 8/1973 | Boyd . | |
| 4,160,940 | 7/1979 | Wolf | 318/803 |
| 4,617,675 | 10/1986 | Ashikaga et al. | 363/41 X |
| 4,626,753 | 12/1986 | Letterman . | |
| 4,678,404 | 7/1987 | Lorett et al. . | |
| 4,785,225 | 11/1988 | Horie et al. | 318/811 |
| 5,057,760 | 10/1991 | Dadpey et al. | 318/807 |
| 5,248,926 | 9/1993 | Kotake et al. | 318/807 |
| 5,249,876 | 3/1994 | Jonsson | 318/803 |
| 5,334,923 | 8/1994 | Lorenz et al. | 318/805 |
| 5,345,160 | 9/1994 | Corniere | 318/811 |
| 5,350,992 | 9/1994 | Colter | 318/807 |

FOREIGN PATENT DOCUMENTS

| | | |
|---|---|---|
| 0100390 | 2/1984 | European Pat. Off. . |
| 3914342 | 11/1990 | Germany . |

*Primary Examiner*—Jonathan Wysocki

*Attorney, Agent, or Firm*—Oblon, Spivak, McClelland, Maier & Neustadt, P.C.

[57] ABSTRACT

A pump control system has a pump unit composed of a turbo pump, a motor for operating the turbo pump, and a frequency/voltage converter for generating a frequency and a voltage to energize the motor. The rotational speed of the turbo pump is varied in order to equalize the current of the motor to a constant current irrespective of the head of the pump. The pump can be operated to take fully advantage of the current capacity of the motor.

16 Claims, 5 Drawing Sheets

PUMP SYSTEM WITH LIQUID COOLING OPERATION

BACKGROUND OF THE INVENTION

1. Field of the Invention

The present invention relates to a pump control system, and more particularly to a system for controlling the operation of either a high-specific-speed turbo pump such as an axial-flow pump or a mixed-flow pump for use in relatively high flow rate and low head applications, or a low-specific-speed pump for use in relatively low flow rate and high head applications, by adjusting the rotational speed of the pump operated by a motor with a frequency/voltage converter (static inverter).

2. Description of the Prior Art

For varying performance characteristics of a pump which is operated by an induction or synchronous motor, there has heretofore been employed a static inverter to vary the frequency of the power supply of the motor to adjust the rotational speed of the pump. To set a rotational speed for the pump, a manual or automatic setting signal is generated by a frequency signal generator within the control range of the inverter which usually ranges from 0% to 120% of the primary frequency of the inverter.

Japanese laid-open patent publication No. 57-52396, for example, discloses an induction motor control apparatus for equalizing the point of intersection between a load torque curve and a motor torque curve to the maximum efficiency point of the motor at a motor input frequency corresponding to the motor torque curve. With the disclosed induction motor control apparatus, the induction motor operates at a maximum efficiency at all times irrespective of the motor input frequency at which the induction motor is energized. Regardless of the rotational speed of a fan coupled to the induction motor, the induction motor can be operated at the maximum efficiency point which corresponds to the motor input frequency at the time.

Another induction motor control apparatus disclosed in Japanese laid-open patent publication No. 59-44997 has a circuit for correcting the output voltage of an inverter depending on the load current of an induction motor so that the output voltage of the inverter reaches a voltage to maximize the efficiency of the induction motor. The disclosed induction motor control apparatus allows the induction motor to be operated highly efficiently irrespective of the operating head of a pump driven by the induction motor, simply by adjusting the primary voltage of the motor depending on the load torque.

Still another induction motor control apparatus has a static inverter for controlling the output power of an induction motor which operates a pump into a constant level, as disclosed in Japanese laid-open patent publication No. 59-25099. Since the motor output power remains constant irrespective of the flow rate Q on a head discharge curve (H.Q curve), the disclosed induction motor control apparatus can lift the H.Q curve to improve operating characteristics of the pump in each of high and low flow-rate regions.

FIGS. 2A through 2C of the accompanying drawings show operating characteristics of a high-specific-speed turbo pump such as an axial-flow pump or a mixed-flow pump for use in relatively high flow rate and low head applications. FIG. 2A illustrates H.Q curves and required power Lp characteristics. Dotted-line curves in FIG. 2A represent characteristics of the pump when the pump is operated by a motor while the frequency of the power supply of the motor is constant. As is well known in the art, when a high-specific-speed pump is operating at a constant power supply frequency, the pump head H sharply decreases in a high flow-rate Q region and increases in a low flow-rate Q region. Therefore, the H.Q curve drops sharply to the right, and the required power Lp also decreases to the right in the graph shown in FIG. 2A. Particularly in the high flow-rate Q region above a rated flow rate, the required power Lp largely decreases as the pump head H decreases.

Stated another way, the marginal power of the motor increases with respect to the motor rated output and the motor does not sufficiently utilize its power in the high flow-rate Q region. If the pump is used as a drainage pump, then when the pump head H decreases, the required power Lp also decreases, making it difficult for the drainage pump to increase the discharged flow rate Q beyond a certain level. Therefore, when the pump head H is low, the drainage pump is required to discharge water for a long period of time. Furthermore, inasmuch as the required power sharply increases in the low flow rate Q region which is about 50% or less of the rated flow rate, if the pump is expected to operate in the low flow-rate Q region, then it is necessary for the motor to have a sufficient rated output power in order to avoid an overload on the motor.

The publications referred to the above disclosed induction motor control apparatuses with various static inverters. However, all of the references fail to disclose an induction motor control apparatus which takes full advantage of the current capacity of the motor that operates the pump. For example, according to Japanese laid-open patent publication No. 59-25099, since the output power of the induction motor is controlled so as to be constant, the voltage V increases and the current I decreases, resulting in a reduced torque while the pump is operating for a low head H and a high flow rate Q. Consequently, there has been a certain limitation to increase the flow rate Q, when the pump is operating for a low head H. The motor cannot be operated fully to its capability by taking full advantage of the full current capacity of the motor.

SUMMARY OF THE INVENTION

It is therefore an object of the present invention to provide a pump control system which can operate a pump fully to its capability by taking full advantage of the full current capacity of a motor irrespective of the pump operating head.

According to the present invention, there is provided a pump control system comprising a pump unit composed of a turbo pump, a motor for operating the turbo pump, and a frequency/voltage converter for generating a frequency and a voltage to energize the motor, and means for keeping a relationship of the voltage to the frequency and varying a rotational speed of the turbo pump in order to equalize a current of the motor to a constant current irrespective of a head of the pump.

By keeping the current of the motor constant while the rate of the voltage to the frequency is constant, the flow rate of the turbo pump, which may comprise a high-specific-speed pump, is greatly increased because the rotational speed increases at a flow rate higher than a rated flow rate and a constant torque is obtained regardless of changes in the rotational speed. At a low flow rate, the rotational speed is lowered, and the motor is prevented from suffering excessive loads, so that the pump can be started and stopped in a shutoff condition.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIG. 6A is a graph according to a conventional pump, and FIG. 6B is a graph according to the second embodiment of the present invention.

DETAILED DESCRIPTION OF THE PREFERRED EMBODIMENTS

Figure 1:
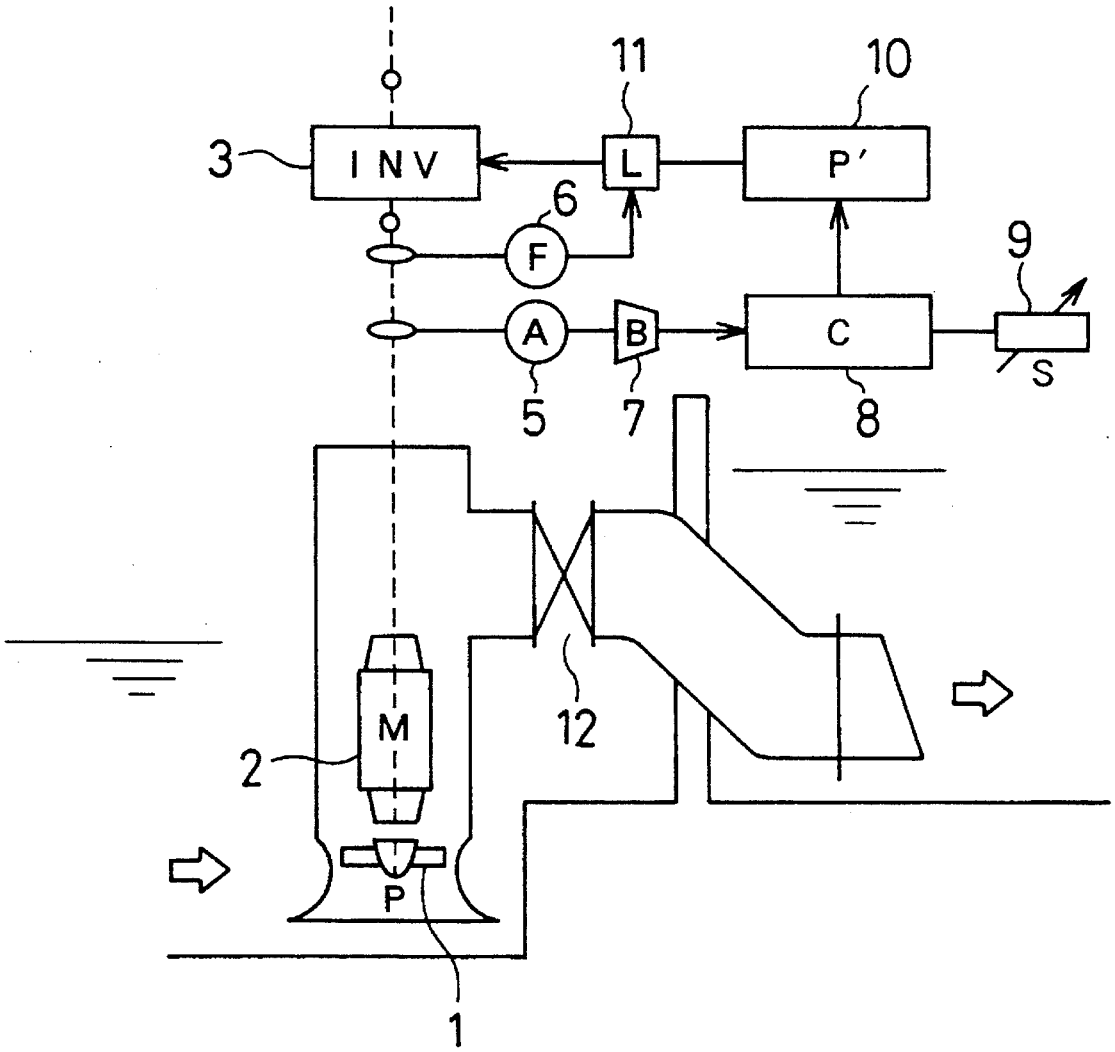
FIG. 1 is a schematic view of a pump control system according to a first embodiment of the present invention.

FIG. 1 schematically shows a pump control system according to a first embodiment of the present invention, which controls a submersible motor pump (drainage pump). The drainage pump, denoted at 1, comprises a high-specific-speed turbo pump such as an axial-flow pump or a mixed-flow pump for use in relatively high flow rate and low head applications. The pump 1 is directly coupled to a three-phase induction motor 2 and can be operated by a frequency/voltage converter (static inverter) 3 which energizes the motor 2. The static inverter 3 converts the frequency F and the voltage V of a commercial AC power supply on a primary side to those on a secondary side. The static inverter 3 is arranged such that the ratio V/F of the voltage V to the frequency F on the secondary side will be constant. When supplied with a signal having a frequency F from a frequency signal generator 10, the static inverter 3 supplies the motor 2 with an electric energy which has the frequency F and a voltage V proportional to the frequency F. The pump 1, the motor 2, and the static inverter 3 jointly make up a pump unit.

The pump control system includes a current detector 5 for detecting a current on the secondary side, i.e., a current supplied to the motor 2, a current converter 7 for converting the detected current to a signal, a current setting unit 9 for setting a certain current value to be supplied to the motor 2, and a comparator 8 comparing the signal from the current converter 7 and the current setting value from the current setting unit 9. The frequency signal generator 10 varies an output frequency signal in response to an output signal from the comparator 8.

The motor 2, which is energized by the static inverter 3 with a variable voltage and a variable frequency, is supplied with a voltage V and a frequency F whose ratio V/F is constant. The torque of the three-phase induction motor 2 is basically determined by current I which flows through the motor 2. If the rotational speed of the motor 2 is varied in order to keep the motor current I constant while the ratio V/F is constant, the torque of the motor 2 is substantially constant irrespective of the rotational speed of the pump 1. Since the current I is constant and the voltage V applied to the motor 2 varies in proportion to the rotational speed of the motor 2, the output power Lp of the motor 2 is proportional to the rotational speed thereof. Therefore, by controlling the output frequency F of the inverter 3 in order to keep constant the current I of the motor 2 irrespective of the head H or the flow rate Q of the pump 1, it is possible to operate the pump 1 while taking full advantage of the current capacity of the motor 2.

To operate the pump 1 in the above manner, the current on the secondary side of the inverter 3, i.e., the current supplied to the motor 2, is detected by the current detector 5. The detected current is then converted by the current converter 7 into an instrumentation signal which is then supplied to the comparator 8. An allowable motor current in an expected frequency range is set by the current setting unit 9. The comparator 8 amplifies and outputs the difference between the motor current setting value from the current setting unit 9 and the detected current signal from the current converter 7. The frequency signal generator 10 varies the frequency F on the secondary side of the inverter 3 and supplies the varied frequency F to the motor 2 in a simple feedback control loop for eliminating the difference between the motor current setting value and the detected current value.

The feedback control loop adjusts the frequency F supplied to the motor 2 such that the motor 2 will be operated with a constant allowable current Io at all times. Specifically, when the pump 1 operates at a high flow rate Q, the current I of the motor 2 decreases, and hence the frequency F increases to cause the current I to approach the constant current Io, resulting in an increase in the rotational speed. Since the ratio V/F is constant, the voltage V increases, and the current I rises to the current setting Io. When the pump 1 operates with a low flow rate Q, the current I of the motor 2 increases, and hence the frequency F decreases to cause the current I to approach the constant current Io, resulting in a reduction in the rotational speed. Since the ratio V/F is constant, the voltage V decreases, and the required power Lp decreases. Because the current I is controlled to be the current setting value Io at all times, no overload occurs at a high or low flow rate.

The pump control system also includes a frequency detector 6 for detecting the frequency on the secondary side of the inverter 3, and a frequency limiter 11 responsive to a detected frequency signal from the frequency detector 6 for shutting off the circuit when the signal from the frequency detector 6 represents a predetermined frequency or higher. The frequency limiter 11 combined with the frequency detector 6 is thus effective to prevent the frequency F and the voltage V from increasing unduly, prevent the pump 1 from developing cavitation and vibration, and also to avoid an excessively high flow rate and an excessively high flow velocity in the pipe when the pump head is low.

Figure 2A:
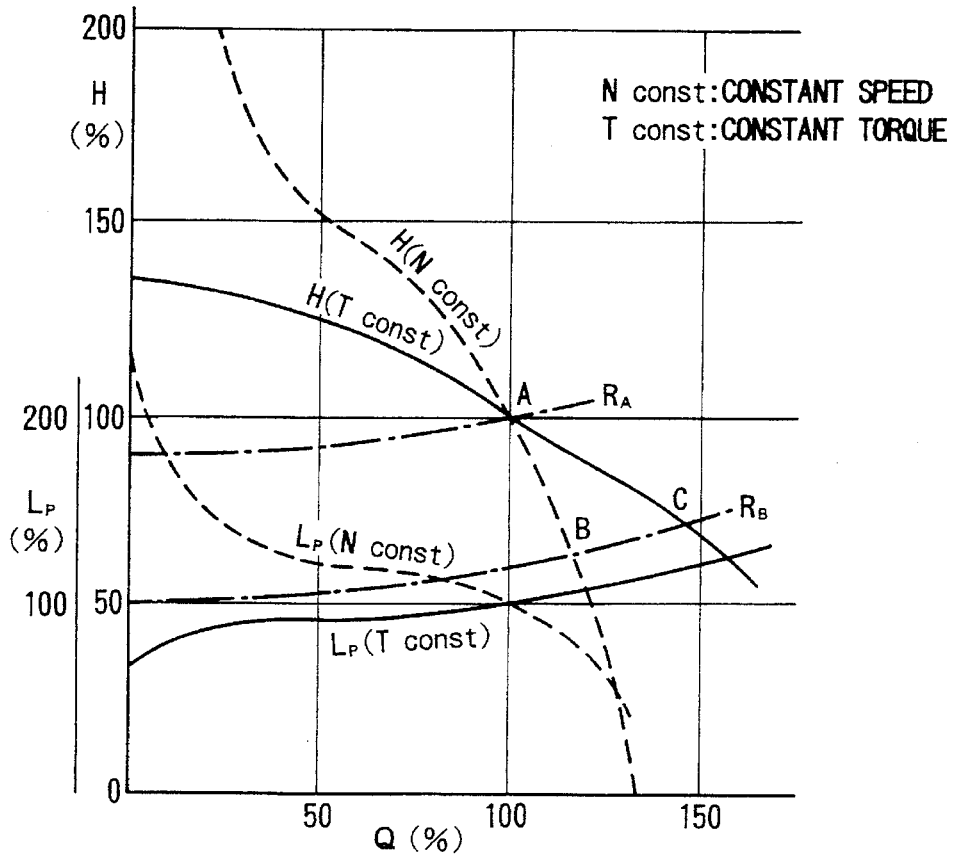
FIG. 2A is a graph showing H.Q curves and the relationship between the power Lp and the flow rate Q of pumps.

FIG. 2A shows H.Q curves and the relationship between the power (Lp) and the flow rate (Q). Dotted-line curves in FIG. 2A represent those of a conventional pump when the pump is operated by a motor while the frequency supplied to the motor is kept constant. Solid-line curves in FIG. 2A represent those of the pump 1 according to the first embodiment of the present invention when it is operated by the motor 2 whose current Io is constant. The H.Q curve of the pump 1 according to the first embodiment is much higher than the H.Q curve of the conventional pump in the high flow rate Q region, and much lower than the H.Q curve of the conventional pump in a low flow rate Q region. The required power Lp of the pump 1 according to the first embodiment of the present invention is much lower than the required power Lp of the conventional pump in the low flow rate Q region, and much higher than the required power Lp of the conventional pump in the high flow rate Q region. The curve of the required power Lp of the pump 1 rises to the right. The rotational speed and the power are about 70% of the rated values when the flow rate is 0, 100% of the rated values when the flow rate is at a rated point, and 125% of the rated values when the flow rate is maximum (150% of the rated flow rate).

When a general purpose standard inverter or the like is used, it may happen that the maximum voltage of the secondary output of the inverter 3 is limited with the voltage of power supply. Then, the rated frequency is usually adopted to be lower than power supply frequency in order to secure smooth operation at over the entire expected range of the pump operation. For an example of a high-specific-speed turbo pump when the power supply frequency is 50 Hz, the rated frequency is set corresponding to 40 Hz to allow to move to maximum frequency operation corresponding to 50 Hz keeping the current constant, when the head becomes minimum.

The high-specific-speed pump is used as a drainage pump or the like having a relatively low head H. The head H varies greatly depending on the difference between internal and external water levels. According to the first embodiment of the present invention, since the H.Q curve of the pump 1 is more gradual than the H.Q curve of the conventional pump, the flow rate increases and the time to discharge water is greatly reduced when the head is low with a high internal water level. FIG. 2A also shows a system head curve Ra at a rated head, and a system head curve Rb at a low head. The operating point of the pump is shifted from an operating point B at the time the conventional pump with a constant frequency is employed as indicated by the dotted line curve to an operating point C, allowing the pump to discharge an increased amount of water when the head H is low as is frequent in the pump operation. When the flow rate Q is low, since the required power Lp is greatly reduced, it is possible to enable shut-off operation of the pump 1.

Figure 2B:
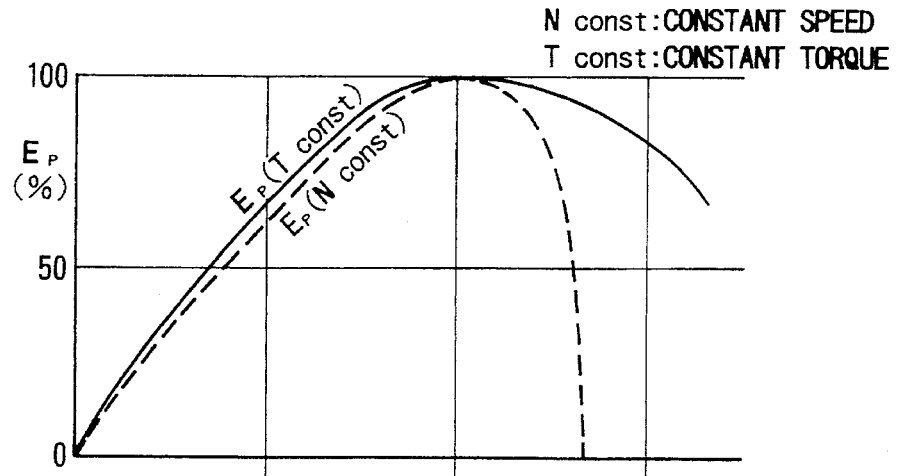
FIG. 2B is a graph showing the relationship between the efficiency Ep and the flow rate Q of pumps.
Figure 2C:
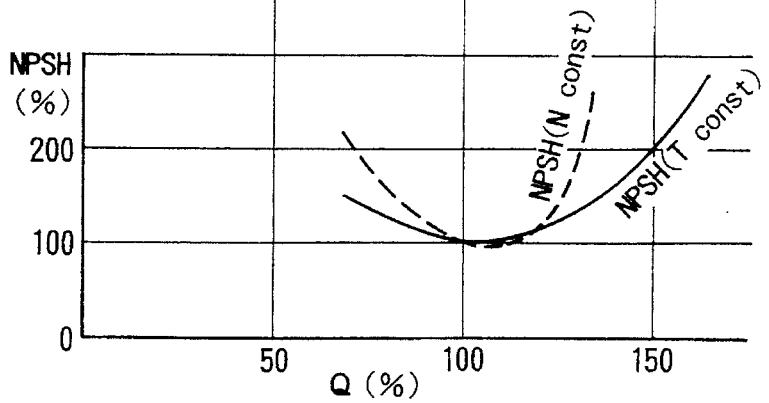
FIG. 2C is a graph showing the relationship between the required net positive suction head NPSH and the flow rate Q of pumps.

FIG. 2B shows the relationship between the efficiency Ep and the flow rate Q, and FIG. 2C shows the relationship between the required net positive suction head NPSH and the flow rate Q. The solid-line curve in FIG. 2B represents the pump efficiency Ep of the pump 1 according to the first embodiment of the present invention. The solid-line pump efficiency Ep curve has greater roundness than the dotted-line curve which represents the pump efficiency of the conventional pump. The pump efficiency Ep is improved when the flow rate Q is high. That is, when the flow rate Q is high, the efficiency of the pump 1 is increased for energy-saving pump operation. As shown in FIG. 2C, the required net positive suction head NPSH of the conventional high-specific-speed pump is higher below and above the rated flow rate as indicated by the dotted-line curve. According to the first embodiment of the present invention, however, since the flow rate which gives a minimum NPSH value varies with the rotational speed, the required net positive suction head NPSH increases to a smaller degree below and above the rated flow rate as indicated by the solid-line curve, thus presenting advantages for the installation or operation of the pump.

A pump control system for controlling a self-lubricated pump according to a second embodiment of the present invention will be described below with reference to FIGS. 3 through 6A and 6B.

The self-lubricated pump comprises a general-purpose low-specific-speed canned pump for use in relatively low flow rate and high head applications.

Figure 3:
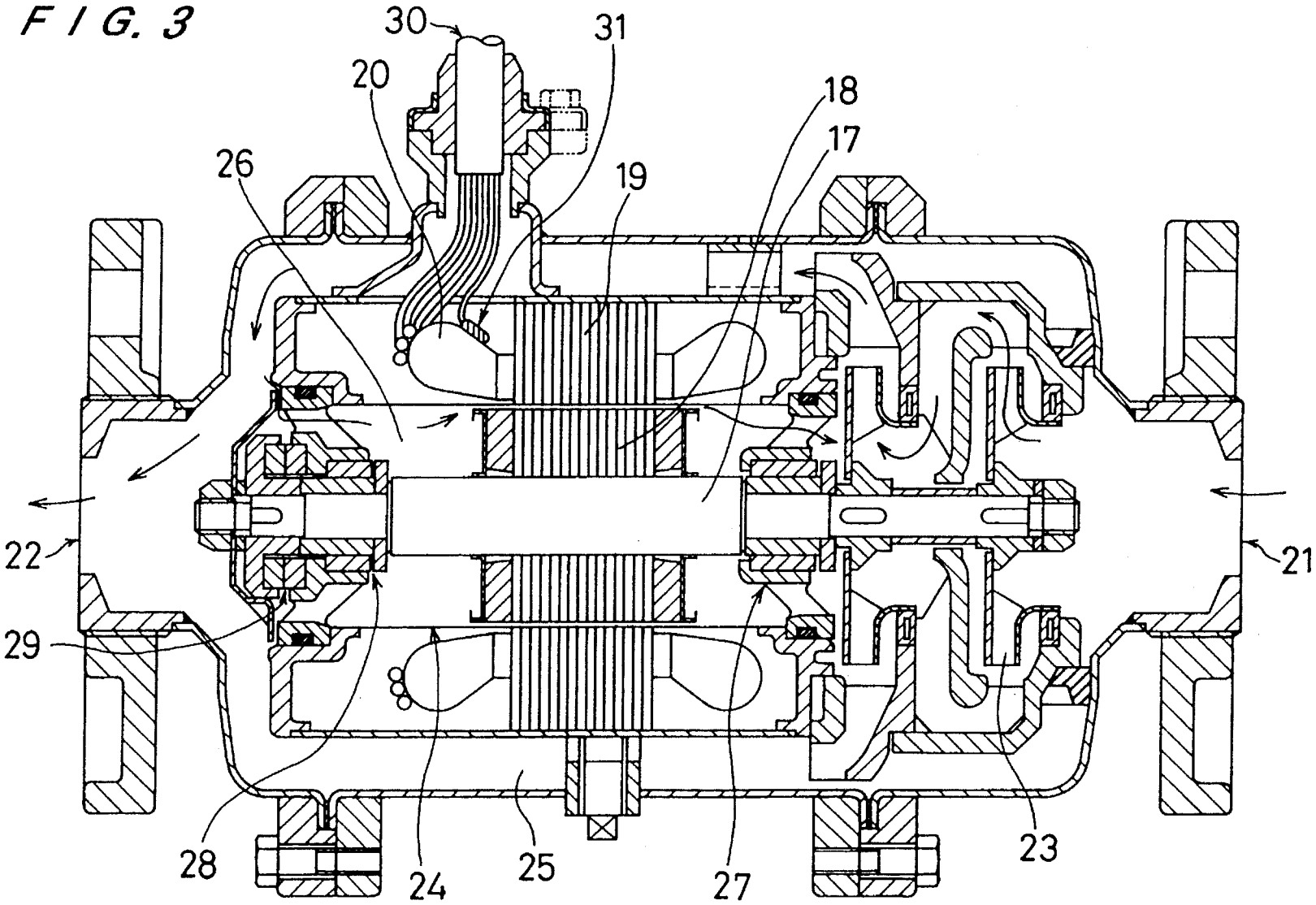
FIG. 3 is a cross-sectional view of a self-lubricated pump.

FIG. 3 shows in cross section the general-purpose low-specific-speed canned pump. The pump shown in FIG. 3 is of the type in which pump bearings are lubricated by a liquid which is delivered under pressure by the pump. And the stator and rotor of a motor which operates the pump, are cooled also by the liquid.

The pump shown in FIG. 3 is an in-line pump having an inlet port 21 and an outlet port 22 which are positioned in axially opposite relation to each other coaxially with a main shaft 17. A motor includes a rotor 18 fixedly mounted on the main shaft 17. An impeller 23 is also fixedly mounted on the main shaft 17. The main shaft 17 is rotatably supported in a can 24 by radial bearings 27, 28 and a thrust bearing 29. The motor also includes a stator 19 which is sealed and mounted in the can 24 in radially surrounding relation to the rotor 18. The stator 19 is energized by a power supply through a cable 30. A liquid which is drawn in through the inlet port 21 is pressurized by the impeller 23. The liquid delivered under pressure by the impeller 23 flows through an annular passage 25 defined around the motor. After having cooling the stator 19, the liquid is discharged from the outlet port 22. A portion of the liquid is introduced into a rotor chamber 26 of the motor in which it cools the rotor 18, and also lubricates the radial bearings 27, 28 and the thrust bearing 29.

In the self-lubricated pump shown in FIG. 3, since the radial bearings 27, 28 and the thrust bearing 29 are lubricated and cooled by the liquid which the pump itself delivers, the heat of the bearings does not affect the temperature of the stator 19. A flow of the liquid through the gap between the rotor 18 and the stator 19 prevents the heat produced by the rotor 18 from affecting the temperature of the stator 19. The temperature of the stator 19 is determined only by the heat which is produced by the stator 19 itself, i.e., the current supplied to the motor. Consequently, if a constant current is supplied to the stator 19, the temperature of the stator 19 is kept constant regardless of the rotational speed of the motor.

Figure 4:
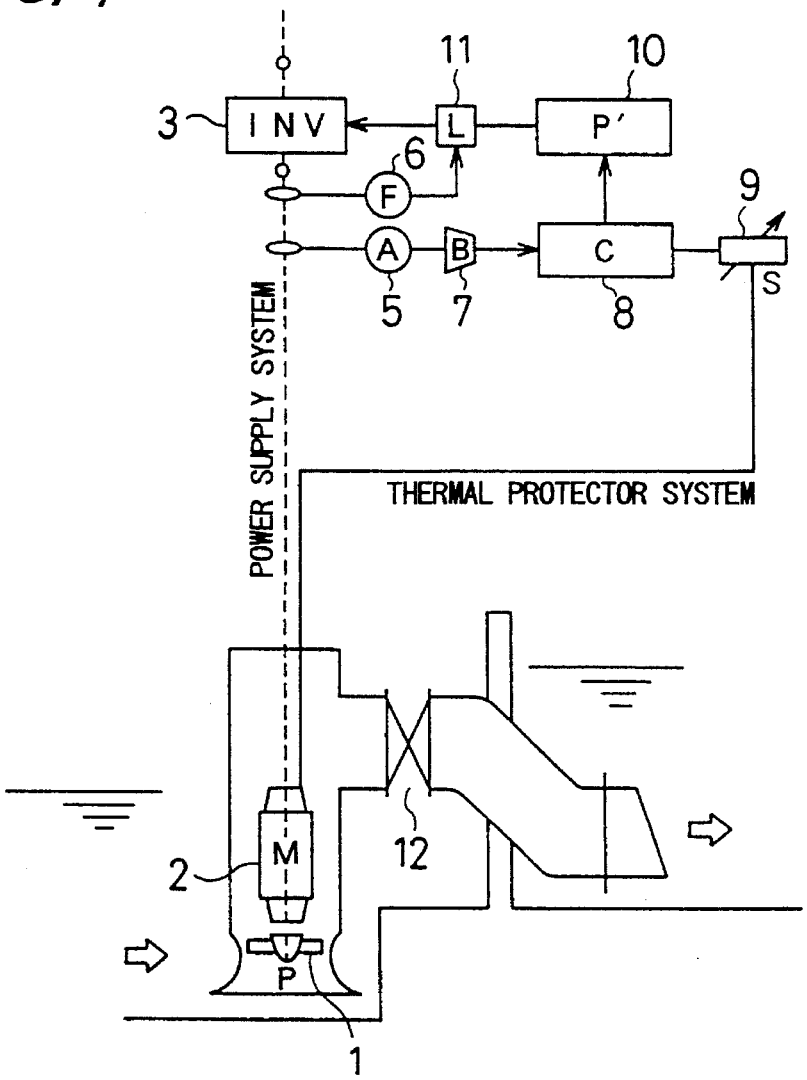
FIG. 4 is a schematic view of a pump control system according to a second embodiment of the present invention, which controls the self-lubricated pump shown in FIG. 3.

FIG. 4 shows the pump control system according to the second embodiment of the present invention. As shown in FIG. 4, the pump control system is similar to the pump control system according to the first embodiment except for thermal protectors and associated cables. The submerged pump, denoted at 1, comprises a low-specific-speed turbo pump such as a self-lubricated pump shown in FIG. 3. The pump 1 is directly coupled to a three-phase induction motor or synchronous motor 2 and can be operated by a frequency/voltage converter (static inverter) 3 which energizes the motor 2. The pump 1, the motor 2, and the static inverter 3 jointly make up a pump unit. The inverter 3 may be encapsulated inside of the pump 1. The static inverter 3 converts the frequency F and the voltage V of a commercial AC power supply on a primary side to those on a secondary side. The static inverter 3 is arranged to have a pre-determined relationship of the voltage V to the frequency F.

A typical relationship of the voltage V to the frequency F is a proportional relationship, namely V/F is constant. However, such a typical relationship is not always required for the inverter 3. The relationship may be such that the voltage V is proportional to square of the frequency F, or non-liner relationship such that when the frequency F is zero, the voltage V is not zero but a small value, when the frequency F is larger, the voltage V is asymptotic to the proportional linear line of the V/F.

When supplied with a signal having a frequency F from a frequency signal generator 10, the static inverter 3 supplies the motor 2 with a voltage V which is a pre-determined value in accordance with the frequency F.

The pump control system includes a current detector 5 for detecting a current on the secondary side, i.e., a current supplied to the motor 2, a current converter 7 for converting the detected current to a signal, a current setting unit 9 for setting a constant current value to be supplied to the motor 2, and a comparator 8 comparing the signal from the current converter 7 and the current setting value from the current setting unit 9. The frequency signal generator 10 varies an output frequency signal in response to an output signal from the comparator 8.

The pump shown in FIG. 3 also includes thermal protectors 31 for detecting the temperature of the stator 19. Cables from the thermal protectors 31 are connected to the current setting unit 9 shown in FIG. 4 directly or indirectly through a control circuit (not shown).

Figure 5:
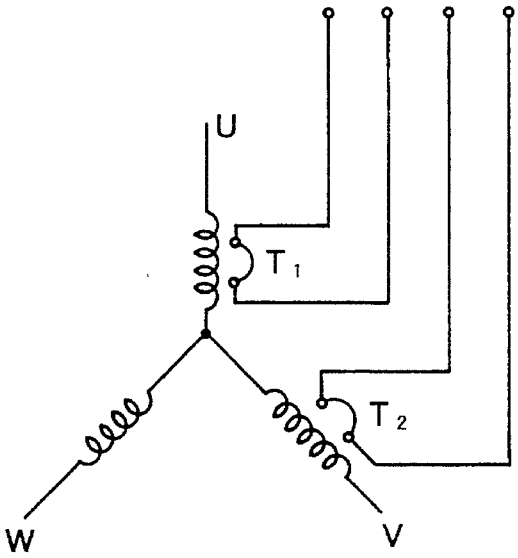
FIG. 5 is a circuit diagram of motor windings associated with thermal protectors.

As shown in FIG. 5, the stator 19 has stator windings, two of which are associated with respective thermal protectors $T_1$, $T_2$ that correspond to the thermal protectors 31 shown in FIG. 3. Each of the protectors $T_1$, $T_2$ comprises a bimetallic switch which is turned on when the ambient temperature is equal to or below a predetermined temperature and turned off when the ambient temperature is higher than the predetermined temperature. The thermal protectors $T_1$, $T_2$ have different operating temperatures. For example, the thermal protector $T_1$ operates at 120° C., and the thermal protector $T_1$ operates at 140° C.

The current setting unit 9 is arranged such that when the thermal protector $T_1$ is turned off, the current setting unit 9 changes a predetermined current setting value $I_1$ to a current setting value 12 which is smaller than the current setting value $I_1$. Specifically, when the thermal protector $T_1$ is turned on, the current setting unit 9 selects the current setting value $I_1$, and when the thermal protector $T_1$ is turned off, the current setting unit 9 selects the current setting value $I_2$. However, when the thermal protector $T_1$ is turned off and then turned on due to a decrease in the stator winding temperature, the current setting unit 9 keeps the current setting value $I_2$.

As described above, when the stator winding temperature exceeds a predetermined temperature as detected by the thermal protectors $T_1$, the current setting value is lowered, and hence the stator winding temperature is then lowered. The motor 2 is controlled by the pump control system shown in FIG. 4 to vary the rotational speed of the pump 1 in order to keep the current constant. By detecting the stator winding temperature and varying the current supplied to the motor 2 in order to keep the stator winding temperature constant, the pump 1 can take full advantage of the current capacity of the motor 1 in a full range of allowable temperatures for the stator windings. Stated another way, because the current varies depending on the temperature of the liquid which flows through the pump 1, it is possible for the pump 1 to take full advantage of the current capacity of the motor 1 up to an allowable stator winding temperature corresponding to the temperature of the liquid.

In the event that the stator winding temperature continues to increase until the thermal protector $T_2$ operates after the thermal protector $T_1$ operates to lower the current setting value from $I_1$ to $I_2$, the power supply of the motor 1 is immediately shut off. When this happens, it is necessary to change the current settings values $I_1$ and $I_2$ as they were unsuitable.

Figure 6A:
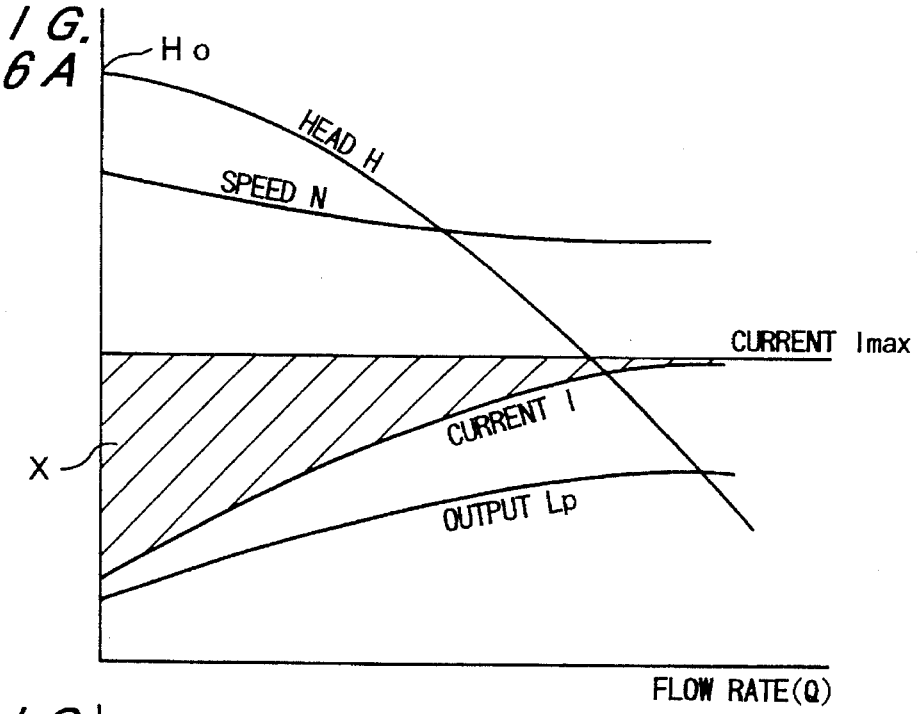
FIGS. 6A and 6B are graphs showing the head H, the rotational speed N, the current I, and the output power Lp which are plotted against the flow rate Q of pumps.

FIG. 6A is a graph showing operating characteristics of a conventional pump with the constant power supply frequency F, i.e., the head H, the rotational speed N, the current I, and the output power Lp which are plotted against the flow rate Q.

With a conventional general-purpose low-specific-speed pump for use in relatively low flow rate and high head applications, the output Lp is low on the shut-off side (lower flow rate) and increases toward a higher flow rate. Therefore, the current I decreases on the shut-off side, with the motor capability being excessive in a hatched area X in FIG. 6A. The H.Q curve shown in FIG. 6A is thus relatively gradually inclined, i.e., it is gradually lowered as the flow rate Q increases.

Because the H.Q curve shown in FIG. 6A is relatively flat, the flow rate Q greatly varies when the head H (water level) varies. In extreme cases, if the head H varies in excess of a shut-off head Ho, then the pump is unable to lift water. The head H of a general-purpose pump may vary to a large extent because such a pump may be used in any of various different places under any of various conditions. The conventional general-purpose low-specific-speed pump with the relatively gradually inclined H.Q curve has been very inconvenient to use when the operating head changes.

Figure 6B:
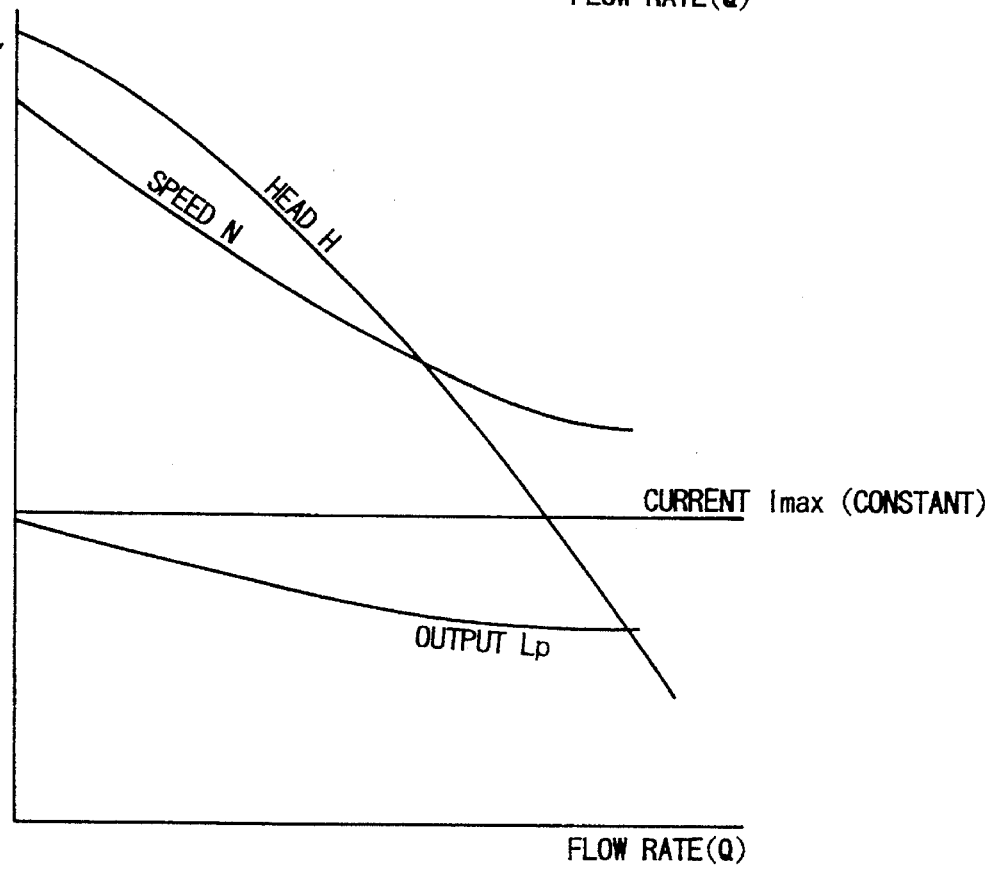

FIG. 6B is a graph showing operating characteristics of the pump 1 according to the second embodiment of the present invention, i.e., the head H, the rotational speed N, the current I, and the output power Lp which are plotted against the flow rate Q. The rotational speed of the pump 1 is varied in order to make constant the motor current I irrespective of the head H of the pump 1. As shown in FIG. 6B, the current Imax is constant regardless of the flow rate Q. The rotational speed N of the pump 1 increases on a shut-off side, and so does the output Lp of the pump 1. Consequently, the H.Q curve shown in FIG. 6B is relatively sharply inclined, i.e., it is sharply lowered as the flow rate Q increases.

Because the H.Q curve shown in FIG. 6B is relatively sharply inclined, the flow rate Q varies to a smaller degree when the head H varies. That is, even when the pump head H varies, any variation in the flow rate Q is held to a minimum. As a general-purpose pump may be used in any of various different places under any of various conditions, the pump is required to lift water stably in a wide range of heads H. The pump control system according to the second embodiment of the present invention can operate a general-purpose low-specific-speed pump easily in a wide variety of conditions.

If the pump control system according to the present invention is used to control a drainage pump for a high flow rate Q and a low head H, then;

(1) it is possible to greatly increase the amount of discharged water at a low head H within a short period of time, (2) it is possible to operate the pump with less energy as the pump efficiency is improved, (3) the pump can be installed or operated advantageously because any change in the required NPSH with respect to the flow rate is reduced, (4) the pump and the motor can be reduced in size, and;

(5) it is possible to close a discharge valve of the pump to start and stop the pump under a shut-off condition, thereby avoiding abrupt flow rate changes when the pump is started and stopped.

If the pump control system according to the present invention is used to control a general-purpose pump for a high head H and a low flow rate Q, then;

(1) it is possible to greatly increase the head H at a low flow rate Q for making the H.Q curve convenient to use, i.e., to give the general-purpose pump suitable operating characteristics for minimizing variations in the flow rate even when the head (water level) varies, and;

(2) it is possible to take full advantage of the current capacity of the motor, to set a maximum (constant) current based on the winding temperature of the motor if used in combination with a self-lubricated pump, and to take full advantage of the current capacity in an allowable range of winding temperatures of such a self-lubricated pump.

Although certain preferred embodiments of the present invention have been shown and described in detail, it should be understood that various changes and modifications may be made therein without departing from the scope of the appended claims.

What is claimed is:

1. A pump system comprising:

a pump unit composed of a turbo pump, a three-phase induction motor for operating said turbo pump, and a frequency/voltage converter for generating a frequency and a voltage to energize said three-phase induction motor, wherein an impeller of said turbo pump and a rotor of said motor are fixedly mounted on a main shaft which is supported by bearings, said motor also comprising a stator;

means for keeping a ratio of said voltage to said frequency constant and varying a rotational speed of said turbo pump in order to equalize a current of said three-phase induction motor to a constant current irrespective of a head of the pump; and means for supplying a liquid pressurized by said impeller to at least one of spaces for thermal isolation between said stator and said bearings and between said stator and said rotor.

2. A pump system according to claim 1, wherein said means comprises a current detecting means for detecting said current of said motor, a current setting unit for setting said constant current, a comparator for comparing the detected current and the set constant current, and a frequency signal generator responsive to an output signal from said comparator for generating a frequency signal to vary said frequency in order to keep constant the current of said three-phase induction motor.

3. A pump system according to claim 2, further comprising means for setting an upper limit for said frequency signal to keep a rotational speed of said turbo pump below a predetermined speed.

4. A pump system according to claim 1, further comprising means for detecting a temperature of a stator winding of said three-phase induction motor, and control means for varying the constant current in order to keep the temperature of the stator winding below a predetermined value.

5. A pump system comprising:

a pump unit composed of a turbo pump, a motor for operating said turbo pump, and a frequency/voltage converter for generating a frequency and a voltage to energize said motor, wherein an impeller of said turbo pump and a rotor of said motor are fixedly mounted on a main shaft which is supported by bearings said motor also comprising a stator;

means for keeping a predetermined relationship of said voltage to said frequency and varying a rotational speed of said turbo pump in order to equalize a current of said motor to a constant current irrespective of a head of the pump; and means for supplying a liquid pressurized by said impeller to at least one of spaces for thermal isolation between said stator and said bearings and between said stator and said rotor.

6. A pump control system according to claim 5, wherein said means comprises a current detecting means for detecting said current of said motor, a current setting unit for setting said constant current, a comparator for comparing the detected current and the set constant current, and a frequency signal generator responsive to an output signal from said comparator for generating a frequency signal to vary said frequency in order to keep constant the current of said motor.

7. A pump control system according to claim 6, further comprising means for setting an upper limit for said frequency signal to keep the rotational speed of said turbo pump below a predetermined speed.

8. A pump system according to claim 5, further comprising means for detecting a temperature of a stator winding of said motor, and control means for varying said constant current in order to keep said temperature of the stator winding below a predetermined value.

9. A pump system comprising:

a pump unit composed of a turbo pump, a motor for operating said turbo pump, and a frequency/voltage converter for generating a frequency and a voltage to energize said motor, wherein an impeller of said turbo pump and a rotor of said motor are fixedly mounted on a main shaft which is supported by bearings, said motor also comprising a stator;

means for equalizing a current of said three-phase induction motor to a constant current irrespective of a head of the pump; and means for supplying a liquid pressurized by said impeller to a space for thermal isolation between said stator and a heat producing portion other than said stator.

10. A pump system according to claim 9, wherein said pump unit comprises a full-circumferential flow pump.

11. A pump system according to claim 9, wherein said pump unit comprises a canned motor pump.

12. A pump system according to claim 9, wherein said heat producing portion other than said stator is at least one of bearings and a motor rotor.

13. A pump system comprising:

a pump unit composed of a turbo pump, a motor for operating said turbo pump, and a frequency/voltage converter for generating a frequency and a voltage to energize said motor, wherein an impeller of said turbo pump and a rotor of said motor are fixedly mounted on a main shaft which is supported by bearings, said motor also comprising a stator;

means for equalizing a current of said three-phase induction motor to a constant current irrespective of a head of the pump; and means for supplying a liquid to a space for thermal isolation between said stator and a heat producing portion other than said stator.

14. A pump system according to claim 13, wherein said pump unit comprises a full-circumferential flow pump.

15. A pump system according to claim 13, wherein said pump unit comprises a canned motor pump.

16. A pump system according to claim 13, wherein said heat producing portion other than said stator is at least one of bearings and a motor rotor.

* * * * *